US006285285B1

(12) United States Patent
Mongrenier

(10) Patent No.: US 6,285,285 B1
(45) Date of Patent: Sep. 4, 2001

(54) DEVICE FOR ASSOCIATING A CONTAINER AND A COMPUTERIZED DEVICE MONITORING ITS CONTENTS

(75) Inventor: Jean-Claude Mongrenier, Saint Germain en Layet (FR)

(73) Assignee: T-LOG S.A., Sevres (FR)

( * ) Notice: Subject to any disclaimer, the term of this patent is extended or adjusted under 35 U.S.C. 154(b) by 0 days.

(21) Appl. No.: 09/647,921

(22) PCT Filed: Apr. 13, 1999

(86) PCT No.: PCT/FR99/00850

§ 371 Date: Nov. 13, 2000

§ 102(e) Date: Nov. 13, 2000

(87) PCT Pub. No.: WO99/53467

PCT Pub. Date: Oct. 21, 1999

(30) Foreign Application Priority Data

Apr. 14, 1998 (FR) ..... 98 04802

(51) Int. Cl.[7] ..... G08B 13/14

(52) U.S. Cl. ..... 340/572.8; 340/572.1; 340/10.1; 340/5.61; 340/541; 340/5.81; 340/5.86; 235/435

(58) Field of Search ..... 340/572.1, 572.8, 340/825.37, 10.1, 5.61, 541, 5.81, 5.86, 5.82; 235/492, 435

(56) References Cited

U.S. PATENT DOCUMENTS

| | | | | |
|---|---|---|---|---|
| 4,871,439 | * | 10/1989 | Enzer et al. | 204/401 |
| 5,618,662 | * | 4/1997 | Lin et al. | 435/2 |
| 5,635,917 | | 6/1997 | Todman | 340/825.37 |
| 5,936,527 | * | 8/1999 | Isaacman et al. | 340/572.1 |
| 6,036,101 | * | 3/2000 | Hass et al. | 235/492 |
| 6,122,704 | * | 9/2000 | Hass et al. | 711/100 |

FOREIGN PATENT DOCUMENTS

96/14043 5/1996 (WO) .

* cited by examiner

*Primary Examiner*—Benjamin C. Lee
(74) *Attorney, Agent, or Firm*—Greenblum & Bernstein, P.L.C.

(57) ABSTRACT

Assembly including a container and a device provided for computerized monitoring of a contents of the container. The device has a flexible support and one of an electronic chip and a memory card affixed to the flexible support. The flexible support comprises a printed circuit and an antenna capable of communicating with a computerized system. The antenna is one of integrated with the flexible support and attached to the flexible support. A protective compartment is provided containing a sample of the contents of the container. The flexible support is coupled to the sample. The protective compartment is removably attached to the container so as to be recouped for the purpose of one of examination or filing.

22 Claims, 4 Drawing Sheets

DEVICE FOR ASSOCIATING A CONTAINER AND A COMPUTERIZED DEVICE MONITORING ITS CONTENTS

CROSS-REFERENCE TO RELATED APPLICATIONS

The instant application is a national stage application based upon PCT/FR99/00850 filed Apr. 13, 1999 which is based upon French priority Patent Application No. 98/04802, filed Apr. 14, 1998 the priority of which is hereby claimed under 35 U.S.C. § 119.

BACKGROUND OF THE INVENTION

Blood transfusion and more generally the medical use of blood and derivative products thereof pose the problem associated with the state of health of the donor(s), involving risk of contamination that can lead to the transmission of diseases to recipients. Blood and plasma donation collection centers currently have databases of information concerning the health history of the donors, which are stored in stationary computerized systems and which can be accessed from a label comprising a bar code read by a laser reader. These labels are affixed on the donation bags and on the corresponding control test tubes. Any supplemental information requires a new label, also comprising a bar code, to be affixed. Thus, a same bag can comprise a plurality of labels comprising a bar code providing access to one or several centralized databases.

It seems increasingly necessary to keep the possibility of subsequent access to the data of the donors or recipient patients, especially in the case of an accident during the transfusion; but also because of the discovery of new diseases whose incubation period is very long; it is then difficult to identify the origin thereof, unless statistical or correlative studies, involving a large number of patients are carried out over long periods of time; and this can be achieved only by systematically accumulating data that can be subsequently sorted out.

The use of labels comprising a bar code implies reading the label with a laser pen to retrieve the data from the corresponding databases, in order to then group and store them for subsequent use in another database. This operation, which is performed a posteriori, requires going back to the original source of the data each time, which is complicated and involves risks of omission, for it is always possible to overlook a label.

SUMMARY OF THE INVENTION

The invention provides an easy and reliable acquisition of the data carried on blood bags and derivative products, and to facilitate access to this data as well as their storage for subsequent processing. The invention can also be used for numerous other applications, such as those which consist of monitoring a cell culture process, for which it is necessary to follow the successive steps, or monitoring an organ removed for transplant.

To this end, and according to one embodiment which utilizes some prior art features identified in documents U.S. Pat. No. 5,635,917 and WO 9614043, the invention provides for coupling at least one electronic chip and/or an electronic memory card to a container, such that they can be easily separated due to simple fixing and protective mechanisms enabling them to be recouped with a sample of the content of the container.

The invention provides an assembly comprising a container, a device for computerized monitoring of a contents of the container, the device having a flexible support and one of an electronic chip and a memory card affixed to the flexible support, the flexible support comprising a printed circuit and an antenna capable of communicating with a computerized system, the antenna being one of integrated with the flexible support and attached to the flexible support, a protective compartment containing a sample of the contents of the container, and the flexible support is coupled to the sample, wherein the protective compartment is removably attached to the container so as to be recouped for the purpose of one of examination or filing.

The protective compartment may be sealed and the flexible support is disposed within the protective compartment. The protective compartment may be integrally formed with the container and the container may be formed from first and second films. One wall of the protective compartment may comprise one of the first and second film of the container. The assembly may further comprise a precut for facilitating a separation of the protective compartment from the container. The protective compartment may comprise an adhesive flexible leaf attached to a wall, the flexible support being disposed between the adhesive flexible leaf and the wall, and the protective compartment may further comprise an opening adapted to receive the sample. The assembly may further comprise a flexible bag formed from plastic films. The flexible bag may comprise a surface having adhesive, the surface having adhesive releasably connecting the flexible bag to the container. The flexible bag may be attached to the protective compartment. The flexible bag may be attached to the container, the flexible bag being attached to one of a middle portion of a wall of the container and a perimeter edge portion of the container. The protective compartment may comprise a sheath which encloses the flexible support, the sheath being welded to the container. The sheath may comprise separating precuts and wherein the sheath comprises two edges which are attached to two corresponding edges of the container. The assembly may further comprise the memory card having a hole, the protective compartment comprising a hole which is aligned with the hole of the memory card. The assembly may further comprise a fixing device disposed in the holes and connecting memory card and the protective compartment. The assembly may further comprise a sheath for removably covering the memory card. The assembly may further comprise the memory card having a hole, wherein the protective compartment comprises a flexible two walled structure having a hole in each wall which is aligned with the hole of the memory card, and further comprising a fixing device disposed in the holes and connecting memory card and the walls of the protective compartment. The assembly may further comprise at least one pipe for delivering the contents into the container. The protective compartment may be connected to the pipe via a connecting sheath. The connecting sheath may be adapted to be hot pressed to the at least one pipe. The protective compartment may comprise a flexible bag which is connected to the at least one pipe. The flexible bag may be connected to the at least one pipe by one of welding and adhesive.

The invention also provides for an assembly comprising a container containing a blood sample, a protective compartment removably attached to the container, a device for computerized monitoring of a contents of the container disposed in the protective compartment, the device having a flexible support and one of an electronic chip and a memory card affixed to the flexible support, the flexible support comprising a printed circuit and an antenna capable of communicating with a computerized system, and the antenna being one of integrated with the flexible support and attached to the flexible support.

DETAILED DESCRIPTION OF THE INVENTION

Figure 8:
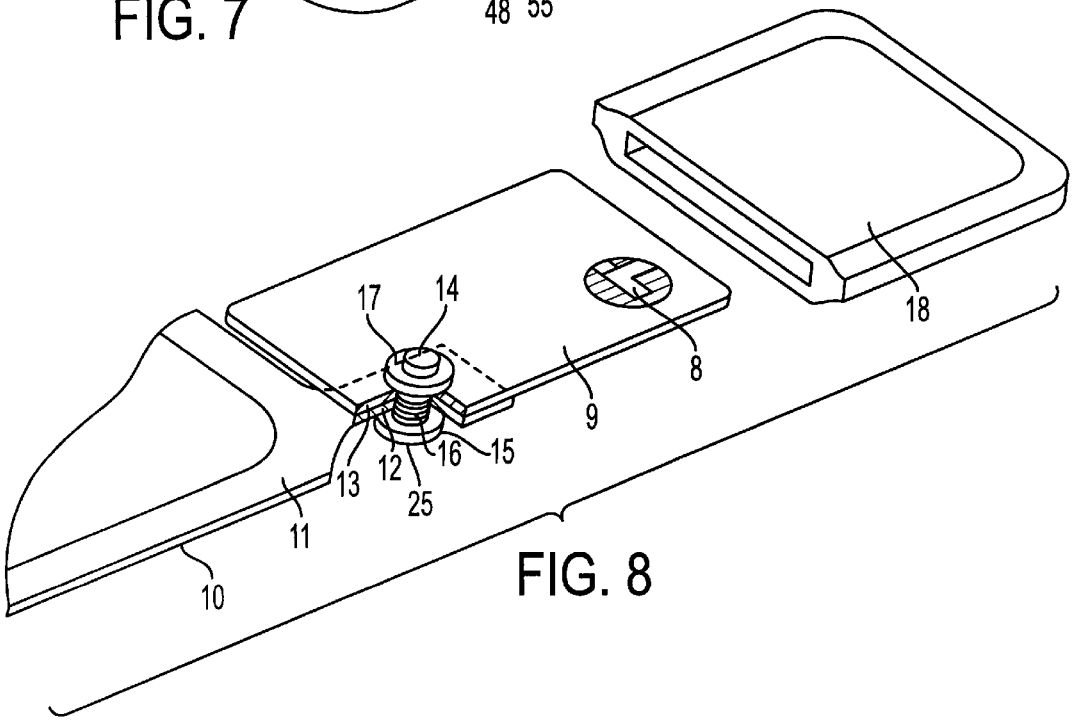
FIGS. 8 and 9 show a perspective partial view of the container equipped, by a fixing mechanism according to a second version of the invention, with a data storing device and a protective mechanism; a gap has been made to facilitate the description.

According to the invention, one couples at least one electronic chip affixed to a flexible support 2 (FIG. 1) and/or at least one electronic memory card 9 (FIG. 8) to a container by fixing mechanism combined with mechanism for protection against the environment of the electronic chip, the electronic chip being capable of being separated from the container by separating mechanism, while being combined by retaining mechanism, with a sample of the contents of the container. The container, the characteristics and evolution of the contents of which must be monitored over time, can be rigid or flexible. In the description that follows, one considers that it is made out of a flexible plastic material having a thin wall, which can be a bag of blood or derivative product. A certain number of mechanism described can be transposed directly or indirectly on rigid containers; whether it be a flexible container or a rigid container, it is up to the person with ordinary skill in the art to select from among the described mechanism those that are best suited for the problem to be solved.

As soon as it is put into operation, the electronic chip makes it possible upon implementing the container 1 and subsequently during the various control steps, to store all of the necessary data which can be reviewed at any time during the lifetime of the container, and thereafter. It suffices to read what is stored in the chip by way of a compatible apparatus to retrieve immediately all of the information necessary for the implementation, regardless of the location where the contents of the container is used.

The electronic chip can be coupled with the container 1 (FIG. 1) during its manufacture, or only at the time it is put into operation. The electronic chip comprises an electromagnetic wave activation and communication device, for example, is combined with a flexible support 2, made of plastic, supporting an electric printed circuit 27, and especially the receiving and emitting antenna. The flexible support 2 is confined in a sealed compartment 3, affixed to the container 1 itself, which is manufactured concurrently with the production of the latter and thus constitutes a protective and fixing mechanism. Thus the flexible support 2 containing the electronic chip is positioned by welding in the location that is provided to form the sealed compartment 3 at the same time as the pipes 5 and 6 which are used to fill and empty the container 1 are positioned on a first film 4 which constitutes one of the walls of the container 1 and of the sealed compartment 3 which covers a form welding counter-electrode. A second film 7, constituting the second wall of the container 1, is placed on the first film 4 supporting the pipes 5 and 6 and the flexible support 2, and an electrode is applied on the assembly thus formed to perform the bonding of the two films 4 and 7 by confining the pipes 5 and 6 and the flexible support 2. The sealed compartment 3 can be separated from the container 1 due to a precut 58; the electrodes used are preferably electrodes that function with high-frequency currents when a blood bag is involved and materials loaded with ethyl vinyl acetate (EVA) resins, are used. But for other applications, it can be electrodes functioning by Joule effect, and more generally as a function of the films used, any other mechanism for fixing the films 4 and 7 to one another, including adhesion or sewing can be envisioned. In the example selected, the chip and the antenna are permanently fixed to one another and introduced in the same compartment. It is possible that, in certain applications, the electronic chip must be confined, for example, in a metallized sealed compartment forming a Faraday cage to prevent its deterioration, but hinders the functioning of the antenna. In these conditions, the electronic chip is provided with electrical contacts that can be accessed from outside the sealed compartment, and which exit therefrom by conductors that can be electrical wires according to the same technique as that used to connect the pipes to the container, or a printed circuit for which sealing is done by adhesion. These electrical contacts can be connected to an antenna affixed to the container, and which remains in place when the sealed compartment containing the chip is separated from the container, or indirectly to a computerized device. In other applications, it could be necessary to arrange a plurality of chips, provided with their own communication system that can be different from one chip to the next, coupled to a same container. All of these variations are a part of the field of application of the invention. Thus, in a blood donor center with voluntary donors, as soon as the donation is authorized by the doctor, the electronic chip affixed to the container, which is a blood bag that is going to receive the blood sample, is activated by way of an interface device connecting the computerized system and the electronic chip, in order to store therein the useful information about the donor and the characteristics of the donation, in particular the analyses to be conducted on the donation, with the corresponding approval criteria. Next, the data concerning the tests performed on the blood donation are introduced therein. In the absence of a more advanced system, one can keep the bar coding system to monitor, the test tubes intended for the check analyses. The results are first stored with the donor's address, from the label affixed to the test tube, in a traditional computerized database. This data is transmitted to the donor center which enters it in the electronic chip of the corresponding bag due to a computerized system verifying the address that was introduced when the electronic chip was activated. Depending on the test results as compared to standards introduced at the time the electronic chip was activated, the bag can be declared suited for transfusion. In the transfusion area, one can have access to the data stores in the electronic chip, and information about the recipient and the conditions of use are introduced therein.

A method of coupling a container 1 with an electronic chip affixed to a flexible support 2 is described hereinabove. This way of operating requires that the support be installed during the manufacture of the container 1, which is not always desired; then, the containers, which are susceptible of receiving an electronic chip, are subject during use to environmental stresses that can be severe; thus, the container may have to withstand centrifugal forces, be kept refrigerated or, conversely, be heated, or subject to water vapor condensation due to the relative humidity of the atmosphere. The centrifugal force can cause the deterioration of the container by the electronic chip or its flexible support which damages the wall of the container. Humidity or heat can cause the separation of the labels. The plastic material constituting the container can be sensitive to the constituents of certain adhesives that migrate through the walls, which requires determining a fixing method as a function of the environmental stresses to which the container must subsequently be subject. A certain number of fixing methods susceptible of being retained are described hereinafter.

Figure 1:
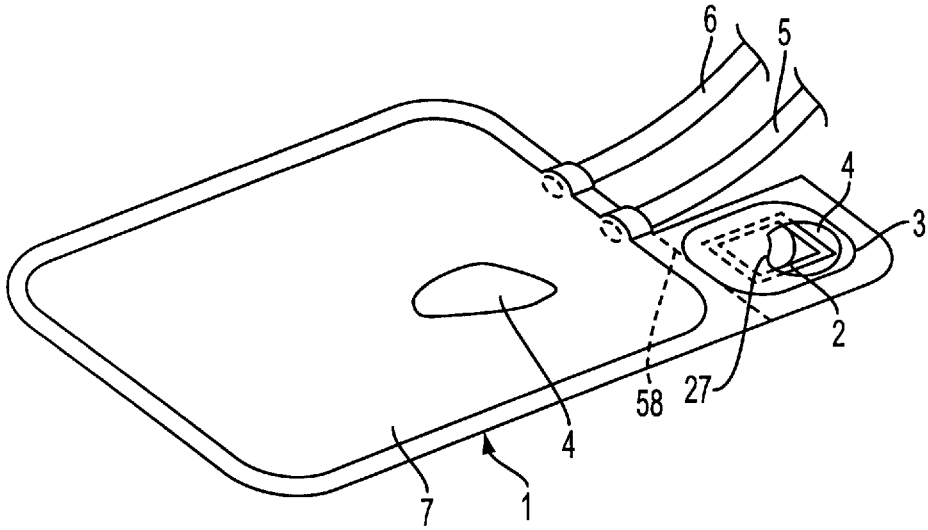
FIG. 1 shows a perspective view of a container equipped with the electronic data storing device fixed to the container by a fixing mechanism according to a first version of the invention; two gaps have been made to facilitate the description of the device.
Figure 2:
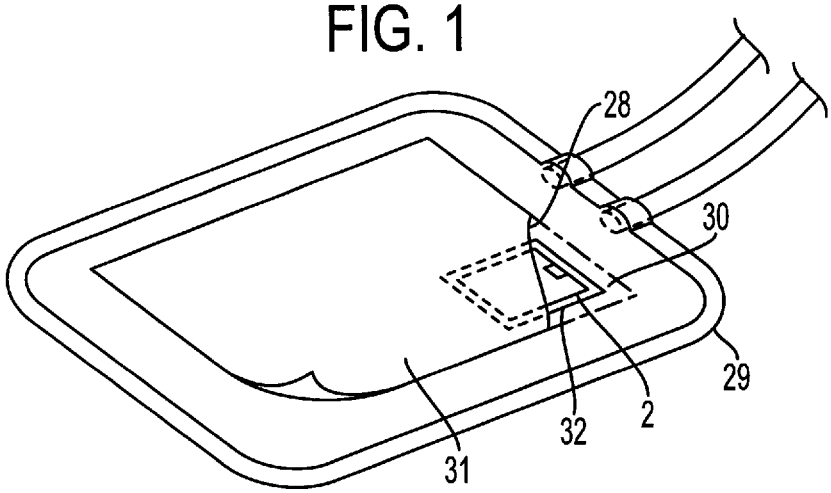
FIGS. 2 and 3 show a perspective view of a container equipped with the electronic data storing device fixed to the container by a fixing mechanism according to another embodiment of the first version of the invention; a gap has been made in each Figure to facilitate the description of the device.
Figure 3:
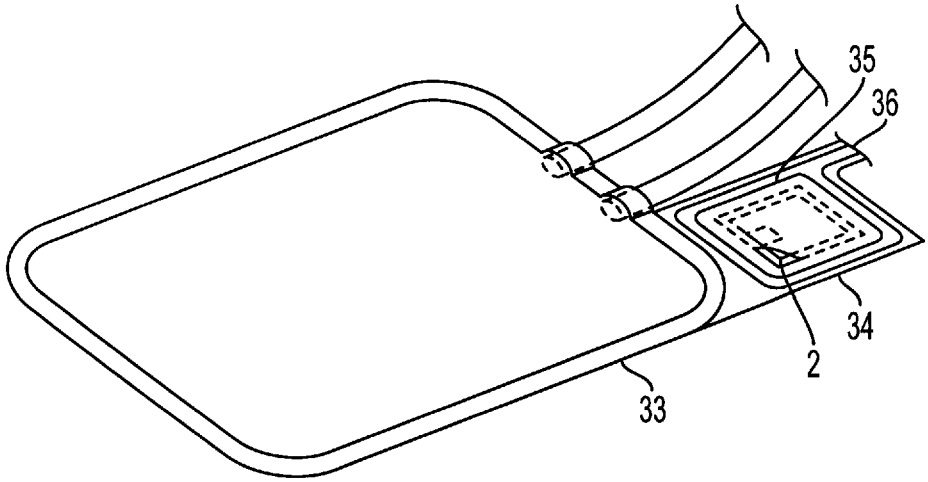
Figure 4:
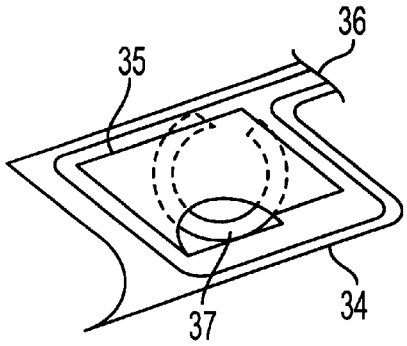
FIG. 4 shows the electronic device and its fixing means when it is separated from the container of FIG. 3; a gap facilitates the description of the device.

In a first version of the invention, the flexible support 2 (FIG. 1) is confined in a compartment formed in particular of at least one of the films used to obtain the container; this is the case of the fixing device previously described in FIG. 1, which is constituted of two films 4 and 7 forming the walls of the container. The compartment 28 (FIG. 2) can be constituted of a wall 30 which is a part of the container 29 and of a flexible leaf 31 that completely covers the flexible support 2 and overlaps the edges 32 thereof so as to be fixed along its contour on the film constituting the other wall 30 of the compartment 28 by welding or adhesion. In this latter case, the adhesion can constitute a separation mechanism by detachment of the leaf 31 from the support 30. The container 33 (FIG. 3) can comprise a compartment 34 that serves as a support for a flexible adhesive leaf 35 confining the flexible support 2, whereas the compartment 34, which does not need to be sealed comprises an opening 36 in which a pipe section closed at its ends, containing blood from the donor, and which is referred to as a flange hereinafter can be inserted. Furthermore, the compartment 34 (FIG. 4) can be detached from the container 33 (FIG. 3) due to a pre-cut constituting a separation mechanism to make it possible to file in the patient's folder the compartment 34 (FIG. 4) containing the electronic chip and a flange 37 containing transfused blood.

Figure 5A:
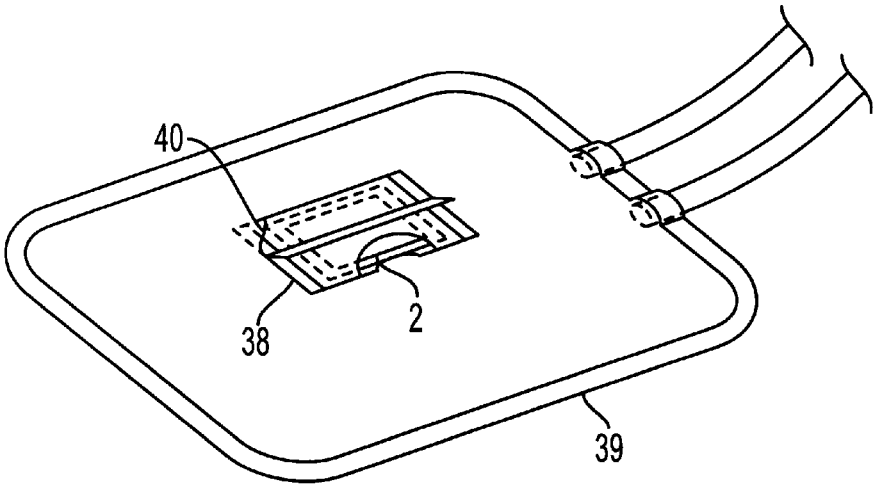
FIGS. 5A and 5B, 6 and 7 each show a perspective view of a container equipped with the electronic data storing device fixed to the container by fixing mechanism according to an alternative embodiment of the invention; a gap has been made in each Figure to facilitate the description of the device.
Figure 5B:
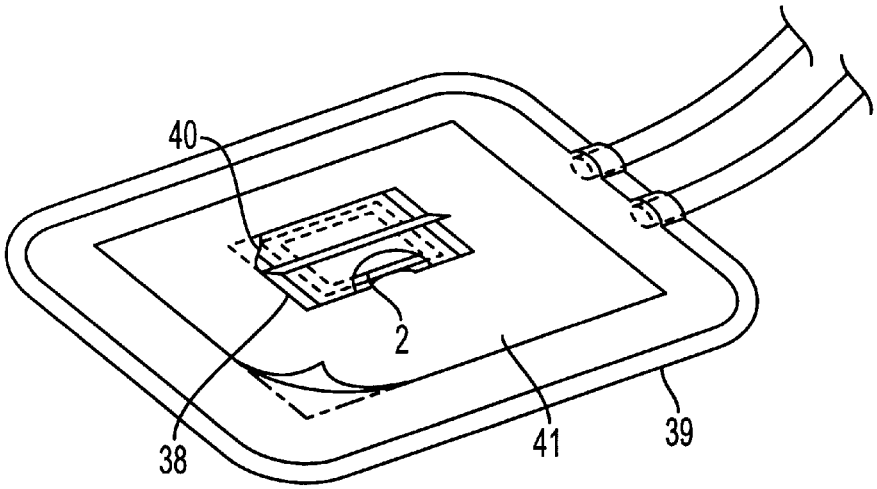

In a variation of the invention, the flexible support 2 is confined in a flexible bag, constituting a protective mechanism made of films of plastic material, separate from the container, and the flexible bag is then fixed directly or indirectly on the container. In a version of this variation of the invention, the flexible bag 38 (FIG. 5A) comprises an adhesive product constituting a fixing mechanism and being capable of constituting a separation and retention mechanism on a surface 40 that makes it possible to fix it directly on a wall of the container 39 or indirectly on a label 41 (FIG. 5B), which is itself fixed directly on the container 39. The flexible bag 38 can also be fixed directly or indirectly on an associated compartment 34 (FIG. 3) with the container 33 as described previously. After the content of the container has been used, the flexible bag 38 (FIGS. 5A and 5B) can be detached from the container 39 and placed in the patient's folder or can continue to monitor the initial content that has been transferred into another container. The adhesive portion 40 of the flexible bag 38 can also be used to fix a flange 37 therein (FIG. 4) containing a sample of the content of the container. The flange 37 can also be possibly introduced into the flexible bag 38 (FIG. 5A and 5B) after an incision constituting another retention mechanism has been made therein.

Figure 6:
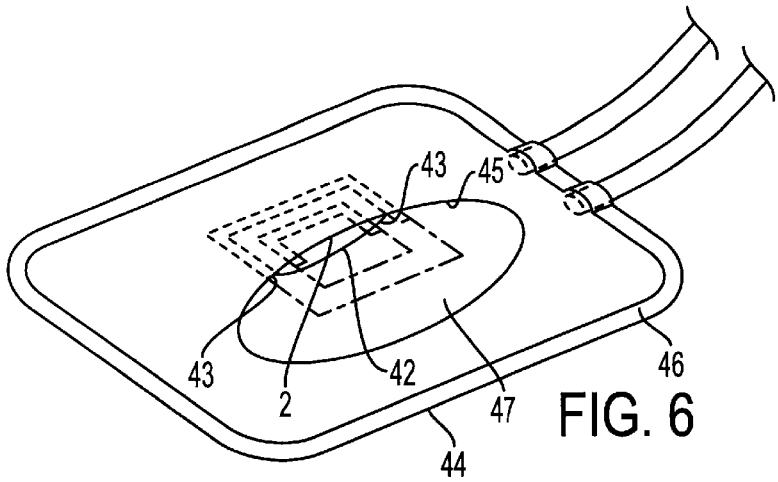
Figure 7:
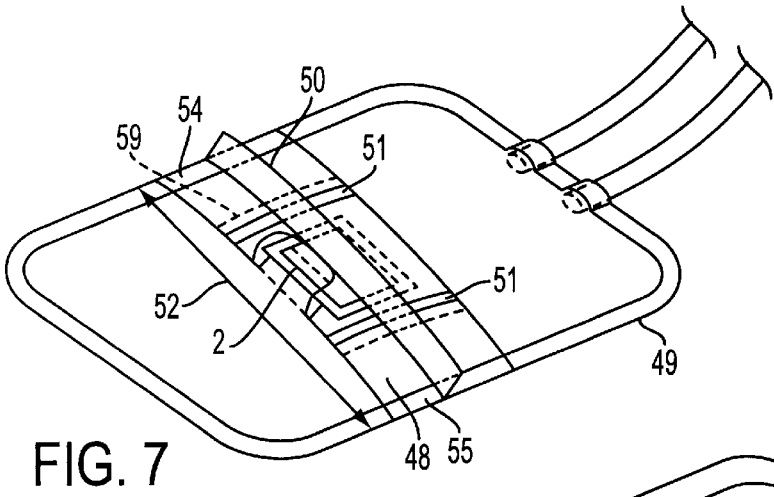

In another version of the variation of the invention, the flexible bag 42 (FIG. 6) containing the flexible support 2 is made out of a material that is capable of being welded by its edges 43, on the container 44 itself. The flexible bag 42 can be welded right in the middle of the wall 45 on one surface of the container 44, either on the outer side or on the inner side, prior to the manufacture of the container 44 itself. The flexible bag 42 can also be welded on the edge 46 of the container 44 at the same time as the edges of the walls 45 and 47 of the container 44 are welded to one another, while being capable of being inside or outside the container 44. The flexible support 2 can be positioned in a sheath 48 (FIG. 7) constituting a protective mechanism at regular intervals whose pitch is the width 52 of a container 49 to be manufactured. The flexible support 2 is positioned on a strip of flat film whose edges 50 are welded longitudinally to form a tube which comprises transverse welding strips 51 on both sides of the flexible support 2 to prevent the flexible support 2 from being displaced along the sheath 48, and possibly precuts 59 positioned outside the compartment formed by the transverse welding beads 51 and parallel to the latter, constituting a separation mechanism. The latter is unwound at the same time as one of the films constituting the container 49 in a manner so as to be positioned transversely with respect to the container 49 and to be welded at the same time as the edge of the container 49, at both ends 54 and 55 of the length of the sheath 48 containing the flexible support 2. The length of the sheath 48 can then be located outside or inside the container 49.

Figure 9:
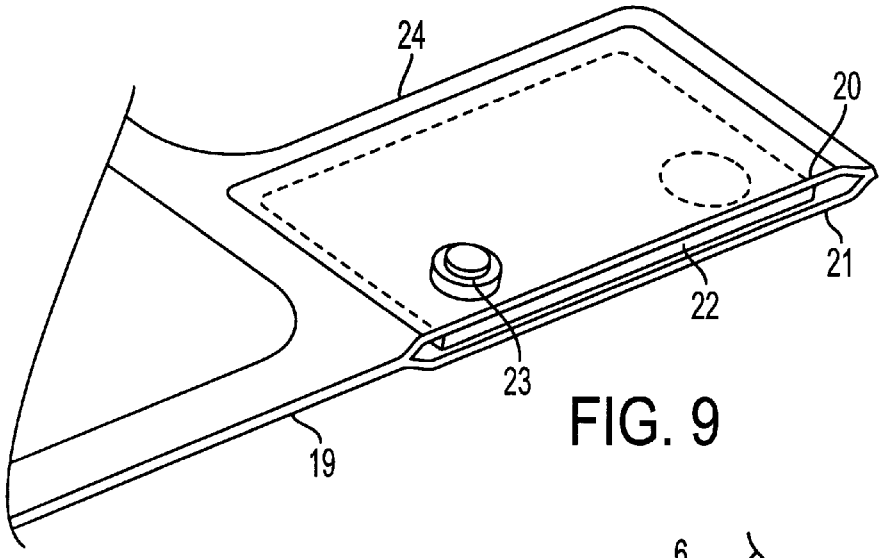

In another version of the invention, the electronic chip is activated by electrical contacts 8 (FIG. 8), as is done for credit cards issued in France. The electronic chip is then fixed on a rigid thin plate made of plastic, to constitute an electronic memory card 9, in a position where it is possible to read it with a standard reader. This electronic memory card 9 is fixed after the container 10 by one of the ends that is not susceptible of hindering the reading of the electronic chip by a movable standard reader. There are numerous ways for fixing the electronic memory card 9 on the container 10. The edge 11 of the container 10 comprises a hole 12 having the same diameter as a hole 13 bored in the electronic memory card 9, and the assembly is fixed with a fixing device 25 of the type of that which is used to fix identification plates on the ears of bovines. A substantially cylindrical first piece 14 is introduced in the hole 12 of the container 10, whose diameter is slightly greater, comprising at its end an abutment 15 that is larger than the hole 12 so as to prevent it from extending through completely, and retentions 16 on its lateral portion. The electronic memory card 9 is inserted in the cylindrical portion of this first piece 14 through the hole 13 which has been previously made therein, and a second piece 17 for blocking the assembly is inserted, which is larger than the diameter of the hole 13 and comprises a bore provided with clipping elements that become blocked on the retentions 16 of the first piece 14. This operation of fixing the electronic memory card 9 is performed preferably at the time the container 10 is put into operation. The electronic memory card 9 is activated, then provided with the container 10 of the personnel responsible for taking the donation, who fixes the electronic memory card 9 as soon as the donation is completed, and who enters pieces of information therein concerning the donation. It can be necessary to protect the electronic chip from atmospheric elements such as humidity or dust, by protective mechanism. It is possible to cover the electronic memory card 9 with a sheath 18 after each use. A sheath 24 (FIG. 9) can be made affixed to the container 19 during its manufacture by forming of two flexible walls 20 and 21 closed on three sides and comprising a hole extending through the two flexible walls 20 and 21, making it possible to the maintain the electronic memory card 22 sandwiched between the two flexible walls 20 and 21, in the same manner as described previously, by way of the fixing device 25. It suffices to make the electronic memory card 22 rotate about its axis 23 to retrieve it from its protective sheath 24.

Figure 10:
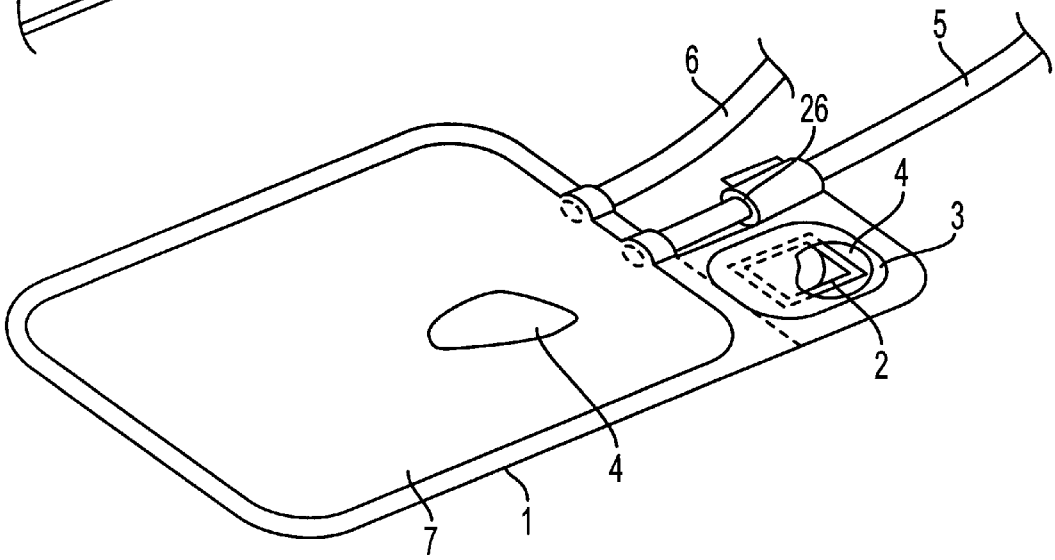
FIG. 10 shows a perspective view of a container equipped with the electronic data storing device fixed to the container by a fixing mechanism according to FIG. 1, on the one hand, and fixed to a pipe, on the other hand.
Figure 11:
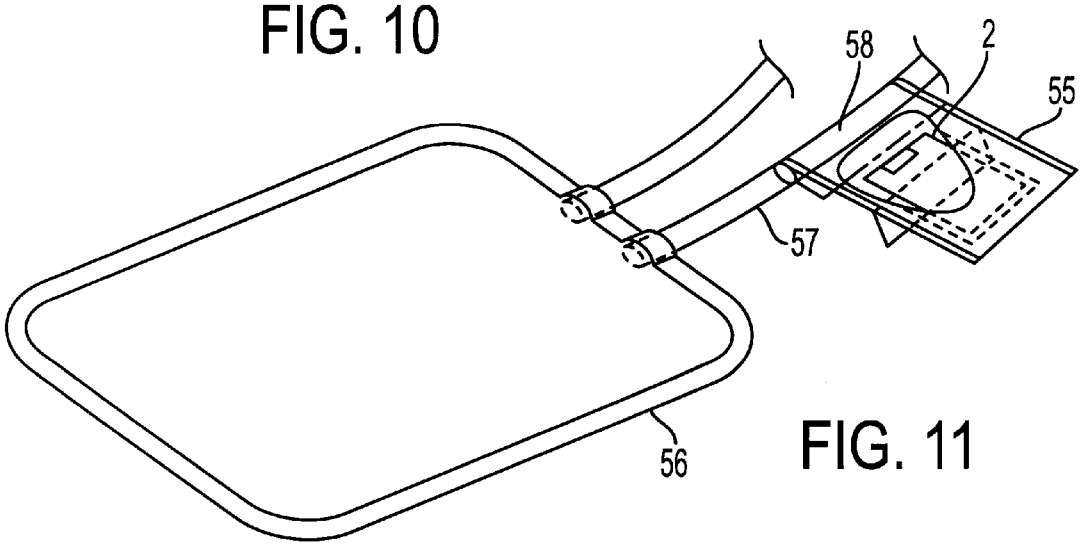
FIG. 11 shows a perspective view of a container equipped with the electronic data storing device fixed indirectly to the container, according to a variation of the invention, via a pipe.

In an improvement of the invention, in the case where the container is a blood or plasma bag, the electronic chip and its flexible or rigid support 2 are positioned in the vicinity of the pipe 5 (FIG. 10) for filling the container 1, such that one can couple thereto, using retaining mechanism, with a flange coming from a segment of this pipe 5 filled with the donor's blood or plasma, and the ends of which have been sealed by hot pressing the pipe 5, at the same time as other segments, which are adapted to the final check of the blood type before the transfusion, are made. The pipe 5 passes between the two films 4 and 7, in their portion that is used to manufacture the sealed compartment 3. In this zone, the pipe 5 can be provided with a sleeve 26 similar to that which is used to obtain the sealing of the assembly of the end of the pipe 5 and of the container. During the formation of the sealed compartment 3, the films 4 and 7 are welded on the sleeve 26. During the donation, the pipe 5 is filled with blood; and when the donation is completed, it suffices to close it on both sides of the sleeve 26 by hot pressing the to constitute the flange. After using the container 1, it is then possible to separate from the container 1 the assembly constituted by the flange and the sealed compartment 3 containing the flexible support 2 so as to store it in anticipation of future examinations. Similarly, when one uses the flexible support 2 (FIG. 11) confined in a flexible bag 55 that is obtained separately from the container 56, the flexible bag 55 can be fixed by any available mechanism on the pipe 57, either by welding during the manufacture of the flanges, or by an adhesive that makes it possible to surround the pipe 57 with one end 58 of the flexible bag 55, which is sealed back over itself.

What is claimed is:

1. An assembly comprising:

a container;

a device for computerized monitoring of a contents of the container;

the device having a flexible support and one of an electronic chip and a memory card affixed to the flexible support;

the flexible support comprising a printed circuit and an antenna capable of communicating with a computerized system;

the antenna being one of integrated with the flexible support and attached to the flexible support;

a protective compartment containing a sample of the contents of the container; and the flexible support being coupled to the sample, wherein the protective compartment is removably attached to the container so as to be recouped for the purpose of one of examination or filing.

2. The assembly of claim 1, wherein the protective compartment is sealed and wherein the flexible support is disposed within the protective compartment.

3. The assembly of claim 2, wherein the protective compartment is integrally formed with the container and wherein the container is formed from first and second films.

4. The assembly of claim 3, wherein one wall of the protective compartment comprises one of the first and second films of the container.

5. The assembly of claim 4, further comprising a precut for facilitating a separation of the protective compartment from the container.

6. The assembly of claim 1, wherein the protective compartment comprises an adhesive flexible leaf attached to a wall, the flexible support being disposed between the adhesive flexible leaf and the wall, and wherein the protective compartment further comprises an opening adapted to receive the sample.

7. The assembly of claim 1, further comprising a flexible bag formed from plastic films.

8. The assembly of claim 7, wherein the flexible bag comprises a surface having an adhesive, the surface having the adhesive releasably connecting the flexible bag to the container.

9. The assembly of claim 7, wherein the flexible bag is attached to the protective compartment.

10. The assembly of claim 7, wherein the flexible bag is attached to the container, the flexible bag being attached to one of a middle portion of a wall of the container and a perimeter edge portion of the container.

11. The assembly of claim 1, wherein the protective compartment comprises a sheath which encloses the flexible support, the sheath being welded to the container.

12. The assembly of claim 11, wherein the sheath comprises separating precuts and wherein the sheath comprises two edges which are attached to two corresponding edges of the container.

13. The assembly of claim 1, further comprising the memory card having a hole, wherein the protective compartment comprises a hole which is aligned with the hole of the memory card.

14. The assembly of claim 13, further comprising a fixing device disposed in the holes and connecting the memory card and the protective compartment.

15. The assembly of claim 13, further comprising a sheath for removably covering the memory card.

16. The assembly of claim 1, further comprising the memory card having a hole, wherein the protective compartment comprises a flexible two walled structure having a hole in each wall which is aligned with the hole of the memory card, and further comprising a fixing device disposed in the holes and connecting the memory card and the walls of the protective compartment.

17. The assembly of claim 1, further comprising at least one pipe for delivering the contents into the container.

18. The assembly of claim 17, wherein the protective compartment is connected to the pipe via a connecting sheath.

19. The assembly of claim 18, wherein the connecting sheath is adapted to be hot pressed to the at least one pipe.

20. The assembly of claim 17, wherein the protective compartment comprises a flexible bag which is connected to the at least one pipe.

21. The assembly of claim 20, wherein the flexible bag is connected to the at least one pipe by one of welding and adhesive.

22. An assembly comprising:

a container containing a blood sample;

a protective compartment removably attached to the container;

a device for computerized monitoring of a contents of the container disposed in the protective compartment;

the device having a flexible support and one of an electronic chip and a memory card affixed to the flexible support;

the flexible support comprising a printed circuit and an antenna capable of communicating with a computerized system; and the antenna being one of integrated with the flexible support and attached to the flexible support.

* * * * *